US007661782B2

(12) United States Patent
Bergstedt et al.

(10) Patent No.: US 7,661,782 B2
(45) Date of Patent: Feb. 16, 2010

(54) CURRENT CONTROL CIRCUIT FOR MICRO-FLUID EJECTION DEVICE HEATERS

(75) Inventors: Steven Wayne Bergstedt, Winchester, KY (US); John Glenn Edelen, Verailles, KY (US); Carson A. Fischer, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 470 days.

(21) Appl. No.: 11/737,261

(22) Filed: Apr. 19, 2007

(65) Prior Publication Data

US 2008/0259105 A1 Oct. 23, 2008

(51) Int. Cl.
*B41J 29/38* (2006.01)

(52) U.S. Cl. ..... 347/9; 347/12; 347/14; 347/10

(58) Field of Classification Search ..... 347/9, 347/10, 12, 14
See application file for complete search history.

(56) References Cited

U.S. PATENT DOCUMENTS 5,083,137 A * 1/1992 Badyal et al. ..... 347/14
5,451,907 A 9/1995 Keane et al.
5,521,620 A * 5/1996 Becerra et al. ..... 347/14
5,541,629 A * 7/1996 Saunders et al. ..... 347/12
6,068,360 A * 5/2000 Hiwada ..... 347/14
6,183,056 B1 * 2/2001 Corrigan et al. ..... 347/14
6,334,660 B1 * 1/2002 Holstun et al. ..... 347/19
6,439,678 B1 * 8/2002 Norton ..... 347/9
6,439,680 B1 * 8/2002 Mochizuki et al. ..... 347/10
6,817,690 B2 * 11/2004 Sato ..... 347/5
6,817,704 B2 11/2004 Eguchi
7,032,986 B2 4/2006 Corrigan
7,175,248 B2 2/2007 Wade
7,196,585 B2 3/2007 Hastings et al.
7,410,231 B2 * 8/2008 Zhao et al. ..... 347/9
7,448,730 B2 * 11/2008 Hirayama ..... 347/59
2005/0062804 A1 * 3/2005 Eaton ..... 347/57
2005/0140707 A1 6/2005 Imanaka et al.
2007/0008380 A1 1/2007 Ushinohama et al.
2008/0043063 A1 * 2/2008 Bergstedt et al. ..... 347/62

* cited by examiner

*Primary Examiner*—Julian D Huffman

(57) ABSTRACT

Current control circuit for micro-fluid ejection heaters. In one embodiment, the current through a heater in a micro-fluid ejection device may be monitored and regulated to maintain a particular value or range of values. In such an embodiment, the heater current may be monitored and compared to a reference value. A signal may be induced based upon the divergence of the heater current from the value and the signal may be applied to the logic switch for the monitored heater. The logic switch may regulate the current through the heater based upon the induced signal. As a result of the regulation of the current, the induced signal may dynamically change thereby allowing fast regulation of the heater current.

19 Claims, 5 Drawing Sheets

CURRENT CONTROL CIRCUIT FOR MICRO-FLUID EJECTION DEVICE HEATERS

TECHNICAL FIELD

This invention generally relates to systems and methods for regulating the heater current in a micro-fluid ejection device. More specifically, one embodiment relates to systems and methods for inducing a signal that is a function of the difference between the heater current and a reference value and controlling the heater current with the signal.

BACKGROUND

In an inkjet printer, better print quality may be achieved by activating each resistive heater element with the same current. However, during the operation of the printer, the current delivered to a heater element in a typical chip is dependent on the electrical effects of varying circuit parasitic resistances. Such parasitic resistances may result from different material thicknesses, compositions and dimensional variations caused by etching and different logic switch resistances for each heater element. The different parasitic resistances may change the voltage and dm current supplied to the beater element and may thereby affect prim quality. One example of this occurs when multiple heater elements attached to the same power line are fired or actuated simultaneously, (i.e. multiple heater elements are "on" during a particular time interval). A parasitic resistance is associated with the power lines leading to each of the heater elements. When multiple elements are fired at the same time, the current passing through the power line prior to reaching the elements increases proportionally to the number of heater elements fired. The increasing current, causes an increased voltage drop across the power line parasitic resistance and thus reduces the current supplied to each element. Additionally, when multiple heater elements are fired at the same time, the parasitic resistance associated with each heater element increases proportionally to the element's physical distance away from the power line. Therefore, the current through each element decreases in proportion to the element's distance from the power line. Thus, heat produced by each element may be inconsistent depending upon the number of elements actuated thereby affecting the print quality.

Better print quality may also be achieved in an inkjet printer by maintaining a constant current through each resistive heater element for the duration of the neater actuation (i.e., the fire pulse). During actuation of the resistive heater element, the heater material temperature coefficient may cause a change in the heater element resistance over the duration of the fire pulse (i.e., as the heater element heats up). The change in the resistance may cause the heat provided by each element to change during the fire pulse. Such a change in heat may affect the consistency of the ejection of fluid onto the media during the fire pulse.

Accordingly, there is a need to improve the consistency of the current (i.e. fire pulse) provided to each actuated heater element regardless of the number of elements actuated or the heater material temperature coefficient.

SUMMARY

According to one embodiment a method for controlling the current through at least one heater element in a micro-fluid ejection device with a compensation circuit is provided. The method comprises powering a plurality of heater elements with a power circuit, and exciting the heater elements by providing current therethrough, coupling at least one logic switch to at least one heater element for selectively applying and controlling power from the power circuit to the at least one heater element, sensing the heater current through at least one heater element and inducing a signal from the heater current, the signal having a magnitude which corresponds to the difference between the magnitude of the current and a reference value, applying the signal to the switch to regulate the heater current and thereby reduce the magnitude of the difference between the current and reference value and changing the signal to reflect the reducing magnitude of the heater current and driving the heater current to the reference value by applying the changing signal to the switch.

According to another embodiment, a method for regulating current through at least one heater element in a micro-fluid ejection de-vice is provided. The method may comprise coupling a logic switch to at least one element and operating the logic switch to produce current through the heater element, driving the current to a reference value by inducing a signal from the heater current, the signal having a magnitude which corresponds to the difference between die magnitude of the current and a reference value, applying the signal to the switch to regulate the heater current and thereby reduce the magnitude of the difference between the current and reference value, changing the signal to reflect the reducing magnitude of the difference and applying the changing signal to the switch.

According to yet another embodiment, a micro-fluid ejection device is provided. The device comprises a plurality of heater elements operable to eject fluid, a power circuit operable to provide power to at least one heater element, at least one logic switch connected to at least one heater element for selectively applying and controlling power from the power circuit to the at least one heater element and at least one compensation circuit comprising a sensing resistor coupled to at least one heater element, an offset circuit for establishing a reference value a differential amplifier having about unity gain and being coupled to the sensing resistor and offset circuit, the differential amplifier responsive to produce a signal having a magnitude corresponding to the difference in heater current and the reference value, a current mirror circuit coupled to the difference in amplifier and a source follower circuit coupled to the current mirror circuit and the logic switch whereby the current mirror translates the signal from the differential amplifier to the source follower to control the switch with the translated signal, the signal operative to reduce the magnitude of the difference between the heater current and reference value wherein the signal is applied to the switch and wherein the signal changes to reflect the reducing magnitude of the difference between the heater current and reference value and drives the current to the reference value.

BRIEF DESCRIPTION OF THE DRAWINGS

It is believed that the present invention will be better understood from the following description taken in conjunction with the accompanying drawings in which.

Figure 1:
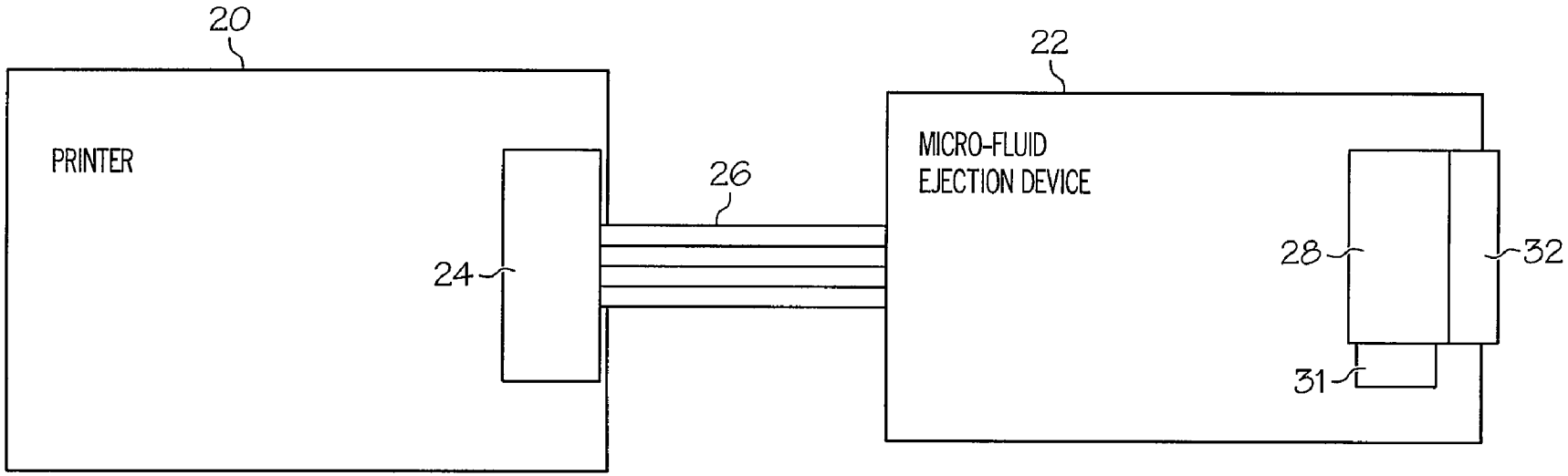
FIG. 1 is a block diagram of a main printer assembly and micro-fluid ejection device in accordance with one illustrative embodiment of the present invention.

The embodiments set forth in the drawings are illustrative in nature and are not intended to be limiting of the invention defined by the claims. Moreover, individual aspects of the drawings and the invention will be more fully apparent and understood in view of the detailed description.

DETAILED DESCRIPTION OF THE ILLUSTRATIVE EMBODIMENTS

Referring to the drawing figures in detail, wherein corresponding numerals indicate the corresponding elements throughout the drawings, FIG. 1 illustrates a printer assembly 20 and micro-fluid ejection device 22 according to one embodiment of the present invention. In one exemplary embodiment, the printer assembly 20 represents the main body of an inkjet printer and may include a media carrier, a micro-fluid ejection device carrier, a housing, a power supply, interconnections for external devices, and an electronics module 24 that may connect to external devices and may also connect to the micro-fluid ejection device 22 through a tab circuit 26. The micro-fluid ejection device 22 includes a power circuit 28 that may be formed on one or more integrated circuits or chips. The power circuit 28 is connected to and provides fee energy necessary to operate the control, circuit 32 and/or a plurality of heater primitives 31. In some embodiments, the control circuit 32 and heater primitives 31 may be built into or integrated into the same chip as the power circuit 28. In yet other embodiments, the control circuit 32 and heater primitives 31 may be built onto separate chips and connected to the power circuit 28 via auxiliary bussing. The control circuit 32 is connected to heater primitives 31 for selectively applying current to the heater primitives 31 to eject fluid onto media, in one embodiment, heater primitives 31 comprise a plurality of heater elements which may be selectively operated by control circuit 32 as is common in micro-fluid ejection devices.

Figure 2:
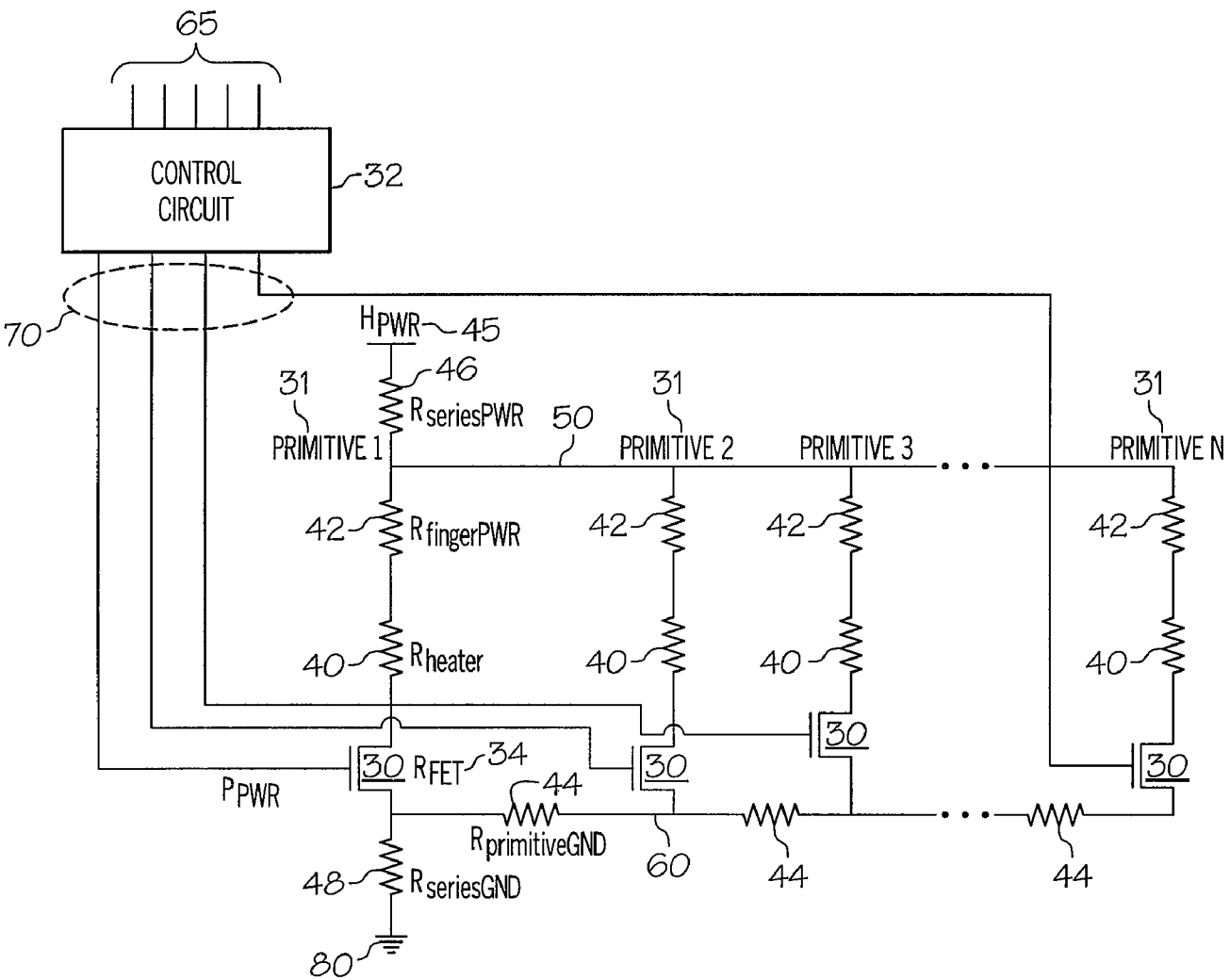
FIG. 2 is a schematic diagram illustrating the operation, of the micro-fluid ejection device control circuit, power circuit, and power logic switches.

Referring now to FIG. 2, schematic details of the micro-fluid ejection device 22 are shown. As illustrated in one embodiment, the heating elements 40 are connected to a power line 50 to provide power to each heating element 40. The heating elements 40 are coupled to associated logic switches 30 which are connected to a ground line 60. As is common, power line 50 and ground line 60 may be coupled to power circuit 28 on FIG. 1 to provide power to the heating elements 40. The control circuit 32 may be connected to the logic switches 30 to selectively control the operation of heating elements 40. The control circuit 32 applies a signal to the logic switch 30 to allow current to pass through the particular heating element 40 connected between the power line 50 and ground line 60. Logic switch 30 may be any transistor such as a BJT, a p-channel MOSFET, a n-channel MOSFET or the like, lit operation, the control circuit 32 may receive data signals and other signals through lines 65 that may be provided by the tab circuit 26 shown in FIG. 1. The data signals provided on lines 65 may correspond to the object to be printed. The control circuit 32 may respond to those data signals by actuating the logic switches 30 (via lines 70) responsible for printing a portion of the object. Control circuit 32 may select a particular heater element 40 to energize within each primitive 31 based upon various firing algorithms or micro-fluid election device designs. Although only four heating elements 40, primitives 31 and logic switches 30 are illustrated, the schematic diagram illustrated in FIG. 2 is intended to illustrate art ink jet printer having any number of heating elements 40, primitives 31 and logic switches 30. Accordingly, the last heater element 40, primitive 31 and logic switch 30 in the circuit is designated with 'N' to illustrate that any number of heater elements 40, primitives 31 and logic switches 30 may be used according to a particular embodiment or design. Additionally, it should be understood that the heater elements 40 associated with each primitive 31 in FIG. 2 are merely illustrative of one heater element 40 selected within, the primitive 31. A plurality of heater elements are provided within each primitive, are connected to power line 50 and ground line 60 and are selected by applying a signal to the logic switch 30 associated with the selected heater element.

Still referring to FIG. 2, the heater element resistances, $R_{heater}$, 40 along with the parasitic resistances associated with each primitive are shown. The resistance value $R_{fingerPWR}$ 42 may represent the metal resistance added to each primitive group to balance the power distribution between all primitives. The resistance $R_{primitiveGND}$ 44 represents the resistance associated with each primitive and the return path to ground. In one embodiment, one power connection 45 and ground connection 80 may be provided for primitives 31. Similar to the power line 50 and ground line 60 above, the power connection 45 and one ground connection 80 may be coupled to power circuit 28. Since each primitive 31 may be connected in parallel to the power connection 45 and ground connection 80, the total $R_{primitiveGND}$ 44 seen by each primitive 31 may be different. Consequently, the resistance value seen by each primitive 31 is proportional to the number of primitives provided in a particular circuit. As is further illustrated in FIG. 2, the resistance values $R_{seriesPWR}$ 46 and $R_{seriesGND}$ 48 represent the series resistance between the ink via (not shown) and the power connection 45 and the series resistance between the ink via and the ground connection 80, respectively. This may be a common resistance shared by all heating elements operated at a given time. Furthermore, the resistance value $R_{FET}$ represents the on-resistance of the logic switch 30 used to select particular heating elements 40 within each primitive 31. Particular values for the circuit may be determined according to the design of the micro-fluid election device.

As is common in micro-fluid ejection device design, the resistance value for $R_{heater}$ 40 may be significantly greater than the associated parasitic resistances. Such a disparity allows maximum power to be provided to $R_{heater}$ 40. As a result, $R_{heater}$ 40 emits heat thereby vaporizing fluid associated with $R_{heater}$ 40 and ejecting such fluid onto media (i.e., paper) provided through a printer. Typically, the amount of heat provided by $R_{heater}$ 40 to vaporize the fluid is proportional to the current provided through the heater.

During micro-fluid ejection device operation, the current provided from $H_{PWR}$ 45 differs according to number of primitives 31 and associated heating elements 40 actuated. In one embodiment, commonly referred to as "single-fire least resistance," the primitive 31 and heater element 40 closest to the power connection 45 and ground connection 80 i.e., Primitive 1 in FIG. 2) are operated independently of other heater elements. In such an embodiment, the resistance provided by $R_{fingerPWR}$ 42, $R_{heater}$ 40 and $R_{FET}$ 34 induces a small current from $H_{PWR}$ 45 thereby providing a minimal voltage drop across $R_{seriesPWR}$ 46 and $R_{seriesGND}$ 48. The minimal voltage drop across $R_{fingerPWR}$ 42, $R_{FET}$ 34, $R_{seriesPWR}$ 46 and $R_{seriesGND}$ 48 (due to the small resistance of each) provides a high voltage drop across $R_{heater}$ 40 and therefore maximizes the power provided thereto. As described above, such increased power provides increased boat from $R_{heater}$ 40. In another embodiment commonly referred to as "all-fire most resistance," when a plurality of primitives 31 and associated heater elements 40 are actuated, the current provided from $H_{PWR}$ 45 increases proportionally with the number of primitives actuated (i.e. the resistances provided by $R_{fingerPWR}$ 42, $R_{heater}$ 40 and $R_{FET}$ 34). The increased current provided from $H_{PWR}$ 45 induces an increased voltage drop across $R_{seriesPWR}$ 46 and $R_{seriesGND}$ 48. Such an increased voltage drop decreases the voltage drop across each $R_{heater}$ 40 and thereby minimizes the power provided thereto. Moreover, there may be an additional voltage drop across the segmented ground resistances $R_{primitiveGND}$ 44 for each primitive 31. Such graduated voltage drops decrease the current provided to each heater element as they are connected further away from power connection 45 and ground connection 80. Therefore, the current provided to the furthest heater element 40 from $H_{PWR}$ 45 may be less than the current provided to the heater element closest to the power connector 45 and ground connector 80. Consequently, when all the primitives 31 are actuated, current provided to all beater elements is minimal. The heat emitted from all activated heater elements during "all fire" is minimal thereby degrading the consistency of the fluid provided to a particular medium. Additionally, the heat, emitted from the heater element furthest from the power connection 45 and ground connection 80 may be less than the heat emitted from closer heater elements thereby degrading the consistency of the ink droplets provided to a particular medium.

Figure 3:
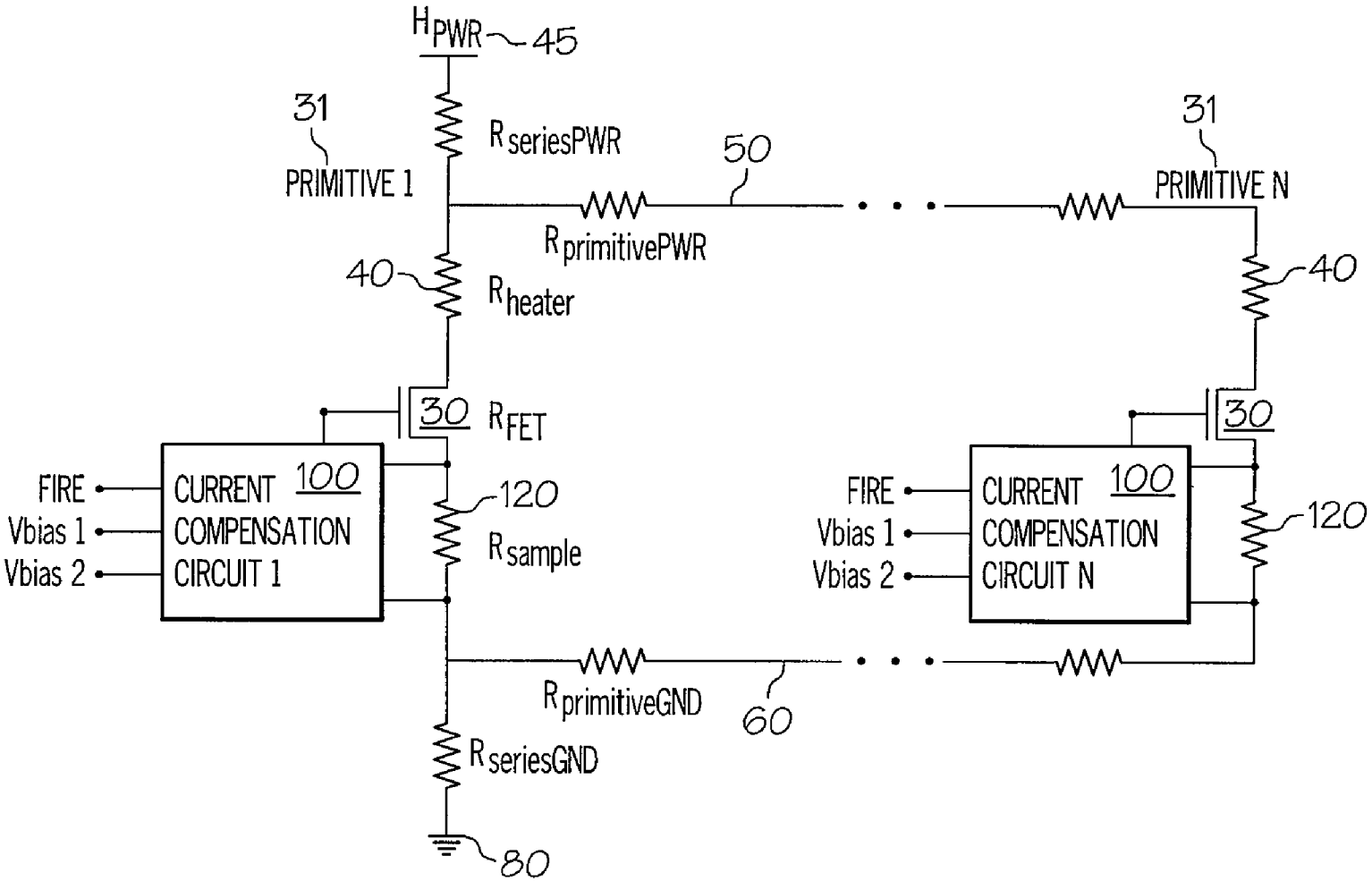
FIG. 3 is a schematic view of a heater element firing circuit, operating in accordance with one illustrative embodiment of the present invention.

As illustrated in FIG. 3 and described further herein, a current compensation circuit 100 is provided to regulate the current through heater element 40 (i.e. heater current) and thereby balance the heat produced by each heater 40. The current compensation circuit 100 may be coupled to various heater elements 40 in accordance with particular embodiments, however illustrative embodiments are contemplated. In one illustrative embodiment, a current compensation circuit 100 may be coupled to each heater 40 provided in a micro-fluid ejection device (i.e., 1 through N current compensation circuits 100 coupled to corresponding 1 through N hearer elements 40). In such an embodiment, each current compensation circuit 100 separately regulates the heater current through each individual, heater element 40. In another illustrative embodiment the current compensation circuit 100 may be coupled to a plurality of heater elements 40. In such an embodiment, current compensation circuit 100 regulates the heater current globally. Thus, the heater current is regulated to a value that best suits the coupled heater elements 40 as a whole, rather than individually as in the previous embodiment. In yet another illustrative embodiment, a plurality of current compensation circuits 100 may be coupled to heater elements 40.

As is further illustrated in FIG. 3, the current compensation circuit 100 is coupled to the logic switch 30 associated with a heater element 40. As is common, the resistance of a logic switch 30 may be controlled with a signal applied to the input of the switch (i.e., the gate). Therefore, by controlling the resistance of the switch 30 with the signal, the current through the switch 30 is controlled accordingly. Thus, as further described herein, the current compensation circuit 100 is operable to monitor the heater current (e.g., through $R_{sample}$ 120) and to provide a signal to the switch 30 to regulate the amount of current provided through the heater element 40. Accordingly, in one embodiment, the current compensation circuit 100 may operate the particular logic switch 30 associated with, the particular heater element 40 monitored by the current compensation circuit 100. However, in some embodiments the current compensation circuit 100 may operate the logic switch 30 associated with a different heater element 40 than the element monitored by the circuit 100.

Typically, as described above, $R_{fingerPWR}$ 42 may be added to the heater element circuitry to provide more uniform power distribution between the heater resistors. Such resistances may be added during the manufacture of the micro-fluid ejection device and may be configured according to the particular micro-fluid ejection device embodiment. It should be understood that with the addition of the current compensation circuit 100, adding a resistor to unify the power through the heater element 40, such as $R_{fingerPWR}$ 42, may not be necessary. Rather, current compensation circuit 100 eliminates the need to add $R_{fingerPWR}$ 42 to the heater element circuitry by regulating the heater current accordingly.

Figure 4:
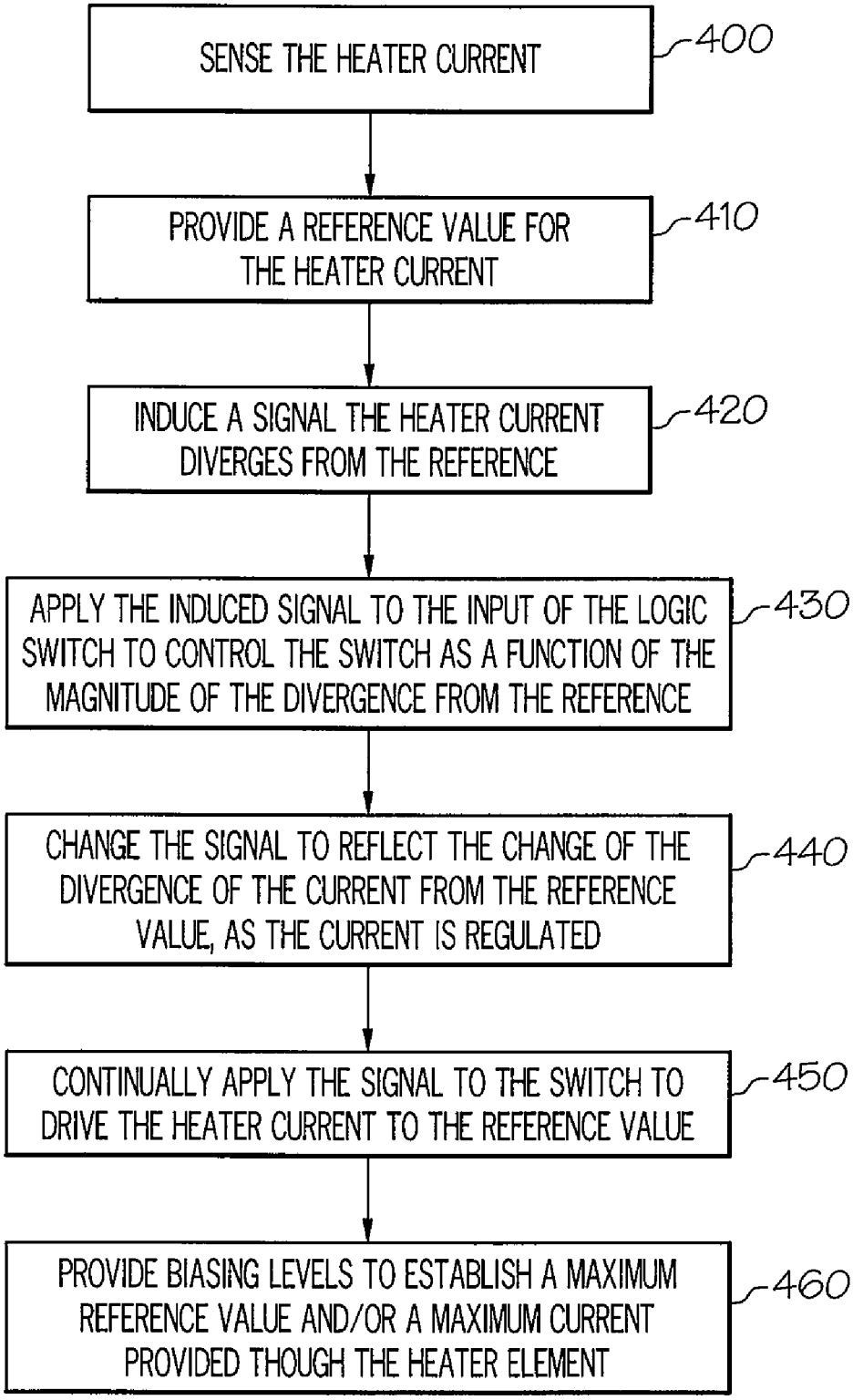
FIG. 4 is a flowchart depicting an example of a method of controlling the current in a micro-fluid ejection heater, in accordance with one embodiment of the present invention.

Focusing now on the embodiment illustrated in FIG. 4, methods for controlling/regulating the heater current with a current compensation circuit 100 in a micro-fluid ejection device may be provided. As illustrated in block 400 of FIG. 4, a variable of the heater current is sensed to compare the variable to a reference (described further herein). The particular variable sensed may differ according to the regulation desired, however, illustrative embodiments are contemplated. In one illustrative embodiment, the magnitude of the current is sensed and regulated. In another illustrative embodiment, the rate of change of the current is sensed and regulated. In yet another embodiment, the frequency of the current is sensed and regulated.

As described above, during actuation of a beater element, the heater current, may be inconsistent between the beaters or inconsistent for the duration of the fire pulse within each heater. Accordingly, a reference value is provided, as illustrated in block 410 of FIG. 4, to establish a regulation point for the heater current. In one embodiment, the reference value is a set of limits (i.e. upper and lower) provided to maintain the current within a given range. If the current falls outside of the range, the current is regulated to bring the heater current to within the range. In another embodiment, the reference value is a limit provided to maintain the current at a particular value. When the current diverges from the limit, the current is regulated to ensure a consistent beater current is maintained between healers and constant current is maintained during the fire pulse. In yet another embodiment, the reference value approximates a rate of change to ensure that the neater current increases or decreases at a particular rate of change (i.e., linearly, exponentially, etc.). When the rate of change of the current diverges from the reference rate of change, the current is regulated. For instance, the rate of change is regulated to maintain a rate substantially similar to the square of the current ($I^2$). Such a rate of change ensures that the powder ($P=I^2R$) through the heater element remains constant.

As illustrated in block 420 of FIG. 4, to maintain the heater current at the reference value, a signal is induced when the beater current diverges from the reference (i.e., breaches a limb, diverges from a set point, changes at a different rate of change, etc). Typically, the signal is directly induced by the heater current (i.e., magnetic induction, current sink, etc. Therefore, the signal is provided concurrently with a divergence of the current away from the reference which may improve the response of the current during regulation (as explained below). The magnitude of the variable signal (i.e., amplitude, frequency, rate of change) may correspond to the amount that the current diverges from the reference. Therefore, the signal not only indicates that a divergence has occurred but also indicates the amount of divergence that has taken place. In an embodiment where the reference is a set of limits that make up a range, the induced signal represents the magnitude of the difference between the current and the allowable range. In an embodiment where the reference is a limit, the induced signal represents the amount that the current should be regulated to achieve the limit. In an embodiment where the reference is a rate of change, the induced signal represents the magnitude of the difference between the rate of change of the current and the reference value. In such embodiments and other similar embodiments, the magnitude of the induced signal may indicate the difference between the current and the reference value proportionally (i.e., the magnitude of the difference may equal the magnitude of the induced signal), inversely (i.e., the magnitude of the induced signal is the inverse of the difference), exponentially or the like. Accordingly, it should be understood that the reference value may pertain to variables other than current amplitude such as frequency, rate of change, or the like.

As illustrated in block 430 of FIG. 4, the induced signal is applied to the logic switch 30 to control the switch as a function of the magnitude of the divergence of the current from the reference. To achieve such control, the logic to respond to the induced signal by minimising the divergence of the current from the reference. In particular, if the induced signal indicates that the current is greater than a reference, the switch 30 may be operable to increase the resistance based upon the signal and thereby reduce the current. Likewise, if the induced signal indicates that the current is less than a reference, the switch 30 should be operable to decrease the resistance based upon the signal and thereby increase the current. Moreover, the switch should be operable to alter the current in accordance with the magnitude of the signal. For instance, if the magnitude of an induced signal indicates a value of divergence, the switch 30 should alter the resistance to change the current by the amount indicated by the signal. In one embodiment, the logic switch is a FET with a proportional voltage-to-resistance characteristic. In such an embodiment, the induced voltage signal drops to indicate that the current is lower than the reference value. Such a drop in voltage may be applied to the input of the logic switch to decrease in the logic switch resistance and thereby reduce the current to the reference value.

As illustrated in block 440 of FIG. 4, because the induced signal is based upon the divergence of the current from the reference value, as the current is regulated, the induced signal reflects any change in the current. Such recursive change in the induced. Signal provides raster regulation of the current with minimal circuitry. As illustrated in block 450 of FIG. 4, continually applying the signal to the switch 30 drives the heater current to the reference value. Such continual application also provides fast regulation of the current and dm current reaches steady state more quickly subsequent to a divergence from the reference.

It should be understood that in the embodiments described above, the logic switch 30 and induced signal correspond to the same heater element 40. However in other embodiments, signals produced by the beater current may be applied to the logic switch 30 for other heater elements 40 in a micro-fluid ejection device.

As illustrated in block 460 of FIG. 4, biasing levels may be provided to establish a maximum reference value and/or a maximum heater current. In one embodiment, a reference bias 182 is established to provide a maximum reference value. In such an embodiment, the reference bias 182 operates as a limit to the magnitude of the induced signal resulting from the divergence of the heater current and the reference. In another embodiment, a maximum current bias 180 is established to provide a maximum heater current. In such an embodiment, the maximum current bias 180 limits the heater current to a particular magnitude or rate of change. It should be understood that the reference bias 182 and maximum bias 180 may be set according to the design or configuration of the micro-fluid ejection device onto which it is implemented. For instance, the biases may be set during manufacture, set by a user during operation, set by the micro-fluid ejection device controller, etc.

Figure 5:
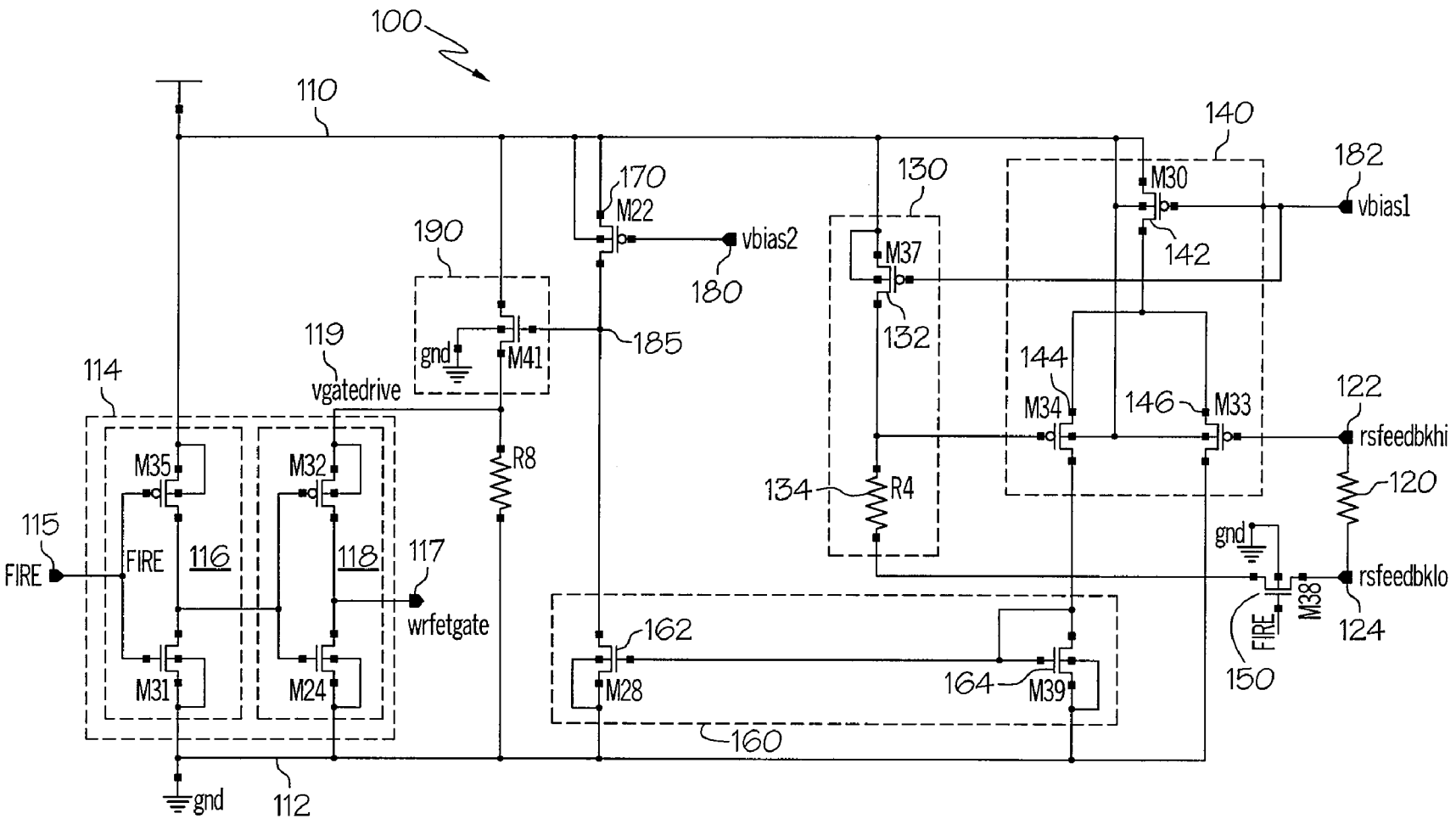
FIG. 5 is a schematic view of a current compensation circuit electrically connected to a heater element firing circuit in accordance with one illustrative embodiment of the present invention.

Focusing now on the embodiment illustrated in FIG. 5, a current compensation circuit 100 is provided to monitor and control the heater current in a micro-fluid ejection device in accordance with one particular embodiment of the present invention. As illustrated in FIG. 3, the current compensation circuit 100 may be coupled to the heater element 40 and the logic switch 30 associated with the heater element. Current compensation circuit 100 may additionally be coupled to a power line 110 and a ground line 112 that provides energy to the current compensation circuit 100. Power line 110 and ground line 112 may receive power from any source on the printer or micro-fluid ejection device, such as $H_{PWR}$ 45. Accordingly, power line 110 may be set at any voltage appropriate to power current compensation, circuit 100 and the associated circuitry. It should be understood that the practical implementations of current compensation circuit 100 may include other logic and circuitry not illustrated in FIG. 5.

Current compensation circuit 100 comprises a buffer circuit 114 coupled to a fire pulse port 115 and an input of an associated logic switch ("pwrfetgate" 117). As illustrated, buffer circuit 114 comprises two inverter circuits 116 and 118. As is common, when fluid is to be elected from a heater element, a fire pulse may be provided. The fire pulse is input into buffer circuit 114 at fire pulse port 115, which is accordingly buffered by the inverter circuits 116 and 118 and provided to the input of the logic switch. As described above, the corresponding heater may thereby be actuated to eject fluid from the heater element 40 on to associated media. As described further herein, the voltage for the signal provided to the logic switch may be determined by the voltage at "vgatedrive" 119 provided from source follower 190.

Current compensation circuit 100 additionally comprises a sensing resistor 120, an offset circuit 130, and a differential, amplifier 140. The sensing resistor 120 is coupled to the beater element 40 (i.e., series, parallel, etc) such that current through the heater element 40 is also provided through the sensing resistor 120. Sensing resistor 120 is also coupled to feedback high port 122 and feedback low port 124 which are correspondingly coupled to the differential amplifier 140 and offset circuit 130, respectively. Although sensing resistor 120 is illustrated as a resistor, it may be any device for producing a signal based upon current or voltage such as a volt-meter, a current meter, a sense or the like. Voltage across sensing resistor 120 may thereby be transmitted to the differential amplifier 140 and offset circuit 130 to monitor the voltage. As illustrated, the feedback low port 124 is coupled to a "fire" transistor 150. Such transistor may be coupled (not shown) to the fire pulse and may permit voltage from sensing resistor 120 to be transmitted only during a corresponding fire pulse. Offset voltage circuit 130 comprises a transistor 132 and an offset resistor 134. The source of transistor 132 is coupled to the power line 110 and the drain of the transistor is coupled to the offset resistor 134. The offset circuit 130 provides an offset voltage for current compensation circuit 100 which may be determined by the size of the resistor. As explained below, the offset voltage may provide a point at which current compensation circuit 100 begins to regulate the heater current.

Differential amplifier 140 comprises three transistors 142, 144 and 146. The source of transistor 142 is coupled to the power line 110, while the drain may be coupled to the sources of transistors 144 and 140, respectively. The gate of transistor 142 is coupled to a bias port 182. As explained above, a reference bias is established with a signal applied to bias port 182 and an adjustable current may be accordingly provided through transistor 142. The gate of transistor 144 is coupled between transistor 132 and resistor 134 of offset circuit 130, and the gate of transistor 146 is coupled to feedback high port 122. When current is provided through the heater element and the sensing resistor 120, the voltage drop across sensing resistor 120 is transmitted to feedback high port 122 and feedback low port 124. Based upon the resistance selected for offset resistor 134, a separate voltage is established across offset resistor 134 in offset circuit 130. As the current increases through sensing resistor 120, the voltage across the resistor 120 at ports 122 and 124 increases. When the voltage across sensing resistor 120 overcomes the voltage across offset resistor 134, differential amplifier 140 begins to operate. The combination of the value of the sensing resistor and the gain of the differential amplifier 140 may provide a reference value for the heater current. As described above, a signal may be induced based upon the difference between the heater current and the reference value. The reference value may be selected to maintain the heater current between a range, at a limit or at a particular rate of charge. Accordingly, the reference value may be set during the manufacture of the micro-fluid ejection device, but may also be set dynamically during operation of the device. As the voltage across sensing resistor 120 increases (diverging from the voltage set by offset circuit 130) a signal is induced through the source of transistor 144 which corresponds to the amount of divergence from the reference value.

In one embodiment the gain of the differential amplifier may determine the type of reference value provided. For instance, a gain of about unity will provide a limit whereby the heater current is maintained at that limit. However, a gain of greater or less than unity may provide a reference rate of change whereby the reference approximates the current necessary to maintain constant power through the heater (i.e., $P=I^2R$). Of course, the value of the gain to maintain such constant power may vary according to the compensation circuit and/or devices included within the micro-fluid ejection device. Although such an approximation (i.e., loose tracking) of the constant power does not provide optimal constant power through the resistor, a loose approximation may allow for near optimal constant power without, the excess logic and silicon necessary to provide such optimal constant power. The lack of additional logic and silicon provides for a more robust, stable and cheaper method to maintain constant power.

The signal induced through transistor 144 is provided to a current mirror 160 connected thereto. As illustrated, current mirror 160 comprises two transistors 162 and 164 which are coupled together at the corresponding gates. The sources of transistors 162 and 164 are coupled to the ground line 112. The drain of transistor 164 is coupled to transistor 144 while the drain of transistor 162 are coupled to a current sink transistor 170. During operation, the signal transmitted from transistor 144 through transistor 164 of current mirror 160 is directly translated to transistor 162. Therefore, the signal through the drains of transistors 162 and 164 may be nearly identical. The drain of the current sink transistor 170 is coupled to the power line 110, and the gate is coupled to bias port 180. As described above, a maximum, current bias may be established with a signal applied to bias port 180. Such a bias may determine the current provided through transistor 170 and may provide a current to compare with the current through transistor 162. In particular, the current provided through transistor 170 provides a maximum current permitted through transistor 162. If the current through transistor 162 (from transistor 164) is less than the current through transistor 170 (maximum current) a voltage is produced at node 185. As illustrated, node 185 is coupled to a source-follower transistor 190. The drain of the source-follower transistor 190 is coupled to the power line 110 and the source of the source-follower transistor is coupled to the inverter circuit 116 within the buffer circuit 114. As is common in a source-follower circuit, the voltage provided at node 185 is correspondingly provided to the source of the source-follower transistor 190. Therefore, the voltage at node 185 is translated to the "vgatedrive" 119 line input to the bailer circuit 114. Such a voltage is transmitted to the input of the logic switch when the corresponding fire pulse is provided to the fire pulse port 115. Since the voltage at node 185 may reflect the divergence between the heater current and the reference (i.e. offset voltage) the logic gate is controlled to minimize such divergence. As a result, the heater current is regulated to the reference value, the signal through the differential amplifier 140 and current mirror may reflect such change and the voltage at node 185 may change to provide fast regulation of the heater current. Accordingly, since the voltage at node 185 is constantly applied during the fire pulse, the heater also achieves steady state quickly.

It should be understood that the various circuits described herein may be substituted with corresponding electronics that perform the same function. For instance, the current through the resistor may be sensed through a toroidal loop. In such an embodiment, the heater current is presided through a toroidal loop. The current provided through the loop produces a resulting voltage that may indicate the current therethrough. In another embodiment, the heater current may be sensed by a current sense coupled to the heater resistor. In such an embodiment, the heater current is provided through a current sense and produces a corresponding current horn the sense. The gain of the current sense may be known and therefore current through the sense may determine the heater current.

Likewise, a reference value for the heater current may be established by an operational amplifier to establish a threshold upon which to initiate regulation. In such an embodiment, the voltage drop across the sensing resistor is provided to inputs of an operational, amplifier. When the voltage across the sensing resistor breaches the limits established by the operational amplifier and associated circuitry, the heater current may be regulated.

Furthermore, a signal may be generated by a signal generator to produce a signal corresponding to the difference between the heater current and the reference value, in such an embodiment, the signal generator may include a current generator, voltage generator, frequency generator or any other generator capable of producing a signal based current compared against reference value.

The foregoing description of the various embodiments of the invention has been presented for the purposes of illustration and description. It is not intended to be exhaustive or to limit the inventions to the precise forms disclosed. Many alternatives, modifications and variations will be apparent to those skilled in the art of the above teaching. For example, the method for controlling heater current in a micro-fluid ejection device may compare heater current to a reference value, induce a signal based upon the difference between the current and the value and control a logic switch continually with the signal. Accordingly, while some of the alternative embodiments of the system for controlling heater current in a micro-fluid ejection device have been discussed specifically, other embodiments will be apparent or relatively easily developed by those of ordinary skill in the art. Moreover, although multiple inventive aspects and features have been described, it should be noted that these aspects and features need not be utilized in combination in any particular embodiment. Accordingly, this invention is intended to embrace all alternatives, modifications, combinations and variations.

What is claimed is:

1. A method for controlling the current through at least on heater element in a microfluid ejection device with a compensation circuit comprising:

powering a plurality of heater elements with a power circuit;

exciting the heater elements by providing current therethrough;

coupling at least one logic switch to at least one heater element for selectively applying and controlling power from the power circuit to the at least one heater element;

sensing the heater current through at least one heater element;

inducing a signal from the heater current, the signal having a magnitude which corresponds to the difference between the magnitude of the current and a reference value;

applying the signal to the switch to regulate the heater current and thereby change the magnitude of the difference between the current and reference value;

modifying the signal to reflect the changing magnitude of the heater current;

regulating the heater current to the reference value by applying the modified signal to the switch; and limiting the heater current through at least one resistor by applying a bias signal.

2. The method as melted in claim 1, wherein the bias signal is fixed during the manufacture of the device.

3. The method as recited in claim 1, wherein the bias signal limits the heater current through only one heater element.

4. The method as recited in claim 3, wherein the bias signal limits the heater current through each heater element in the micro-fluid ejection device.

5. The method as recited in claim 3, wherein the bias signal limits the heater current through each heater element in a primitive.

6. The method as recited in claim 1, further comprising limiting the induced signal to at least one switch by applying a bias signal.

7. The method as recited in claim 6, wherein the bias signal is set during the manufacture of the device.

8. The method as recited in claim 7 wherein the bias signal limits the induced signal through only one switch.

9. The method as recited in claim 6, wherein the bias signal limits the induced signal through each switch in the microfluid ejection device.

10. The method as recited in claim 6, wherein the bias signal limits the induced signal through each switch, in a primitive.

11. The method as recited in claim 1, wherein the reference value is constant.

12. The method as recited in claim 1, wherein the reference value changes to maintain constant power through at least one heater element.

13. The method as recited in claim 12, wherein the change of the reference value approximately replicates the change in current necessary to maintain constant power.

14. A method for regulating current through at least one heater element in a micro-fluid ejection device comprising:

coupling a logic switch to at least one heater element;

operating the logic switch to produce current through the heater element; and regulating the current by:

inducing a signal from the heater current, the signal having a magnitude which corresponds to the difference between the magnitude of the current and a reference value;

changing the reference value to approximate the rate of change of the current necessary to maintain constant power through the element using the equation $$P=I^2*R;$$

applying the signal to the switch to regulate the heater current to the reference value; and modifying the signal to reflect the changing difference between the current and the reference value;

applying the changing signal to the switch; and limiting the heater current through at least one resistor by applying a bias signal.

15. A micro-fluid ejection device comprising:

a plurality of heater elements operable to eject fluid;

a power circuit operable to provide power to at least one heater element;

at least one logic switch connected to at least one heater element for selectively applying and controlling power from the power circuit to the at least one heater element; and at least one compensation circuit comprising:

a sensing resistor coupled to at least one heater element;

an offset circuit for establishing a reference value;

a differential amplifier having about unity gain and being coupled to the sensing resistor and offset circuit, the differential amplifier responsive to produce a signal having a magnitude corresponding to the difference in heater current and the reference value;

a current mirror circuit coupled to the differential amplifier; and a source follower circuit coupled to the current mirror circuit and the logic switch whereby the current mirror translates the signal from the differential amplifier to the source follower to control the switch with the translated, signal, the signal operative to reduce the magnitude of the difference between the heater current and reference value;

wherein the signal is applied to the switch; and wherein the signal changes to reflect the reducing magnitude of the difference between the heater current and reference value and drives the current to the reference value.

16. The device as recited in claim 15, further comprising bias ports for setting a heater current limit and induced signal limit.

17. The device as recited in claim 16, wherein the bias level is set during the manufacture of the device.

18. The device as recited in claim 15, wherein the reference valve changes to maintain constant power through at least one heater element.

19. The device as recited in claim 18, wherein the reference value changes to approximate the rate of change of the current necessary to maintain constant power through the element.

* * * * *